United States Patent [19]

Rehm et al.

[11] 4,387,558

[45] Jun. 14, 1983

[54] METHOD FOR LINING A HOUSING OF A FIBER OPENING DEVICE AND ROLLER

[76] Inventors: Siegfried Rehm, Westeranger 4, 8071 Stammham; Kurt Beizinger, Dorflerstr. 10, 8070 Ingolstadt, both of Fed. Rep. of Germany

[21] Appl. No.: 217,108

[22] Filed: Dec. 16, 1980

Related U.S. Application Data

[63] Continuation-in-part of Ser. No. 31,224, Apr. 8, 1979, Pat. No. 4,246,745.

[51] Int. Cl.[3] ..... D01H 7/895; D01H 7/892

[52] U.S. Cl. ..... 57/408; 57/410; 29/523

[58] Field of Search ..... 57/58.89, 58.91, 58.95; 19/86, 97, 82; 29/522, 523, 526

[56] References Cited

U.S. PATENT DOCUMENTS

| | | | |
|---|---|---|---|
| 3,534,988 | 10/1970 | Lindsey | 29/523 X |
| 4,024,699 | 5/1977 | Goldammer | 57/408 X |
| 4,201,037 | 5/1980 | Artzt et al. | 57/58.91 X |
| 4,269,438 | 5/1981 | Ridenour | 29/523 X |

*Primary Examiner*—Donald Watkins

[57] ABSTRACT

The present invention relates to a method and apparatus for lining a housing which receives an opening roller of a fiber opening device for an open-end spinning apparatus by means of a finite metal band, wherein the housing comprises apertures in its generated surface which connect the interior of the housing to other parts of the spinning apparatus and to which apertures in the metal band correspond.

2 Claims, 6 Drawing Figures

METHOD FOR LINING A HOUSING OF A FIBER OPENING DEVICE AND ROLLER

BACKGROUND OF THE INVENTION

This is a continuation-in-part of application Ser. No. 31,224, entitled APPARATUS FOR LINING A HOUSING OF A FIBER OPENING DEVICE AND ROLLER, filed on Apr. 8, 1979, U.S. Pat. No. 4,246,745.

Because of the very large amount of fiber passed through a fiber opening device of an open-end spinning apparatus, the interior wall of the opening device is subject to severe wear. Heretofore, inserts in the form of metal bands have been utilized to lessen this problem.

Even though this wear is considerably reduced in comparison with housings without an insert, nevertheless, when using inserts, it is necessary to replace these from time to time. In the known constructions (DE-AS No. 2,448,685, DE-OS No. 2,423,241), the insert is adhesively secured into the housing, which greatly increases the difficulty of replacing the insert. Further disadvantages of adhesively fitting the insert in the housing appear if the inside shape of the housing differs from the circular shape, because in the event of tolerance dimensions coinciding unfavorably, the insert can come loose from the inside shape of the housing adversely affecting the operation of the fiber opening device. The same effect can occur if the feeding trough cooperating with the deliver roller is supported on the insert from the outside.

Accordingly, an important object of the present invention is to provide a method and an apparatus which provide on the one hand a quick replacement of an insert in the form of a band and on the other hand an insert which always bears tightly against the inside of the housing regardless of the deviations in the contour.

SUMMARY OF THE INVENTION

According to the invention, a metal band is laid in the housing so that a joint thereof, as viewed in the direction of conveyance of the fiber, is disposed between an aperture in the housing leading to a feed passage and an aperture leading to a delivery device in the housing, that, furthermore, the metal band is caused to bear against the inner wall of the housing by tightening, and that the metal band thus tightened is secured in the housing by a quick release connection only in the region of the joint. Since the connection to the housing can be rapidly undone and is only provided at one point of the periphery of the inner wall of the housing, it is possible to disconnect the metal band in a simple manner if necessary and to exchange it for another metal band.

In order to carry out the method, the joint between the two ends of the metal band, as viewed in the direction of fiber conveyance, is disposed between an aperture leading to a feed passage and an aperture leading to a delivery device in the housing, and, in the region of the joint, the housing wall comprises an outside aperture connected to the outside of the housing and a tightening device is introduced into the outside aperture which presses the metal band tightly against the inner wall of the housing. The two ends of the metal band are urged apart by the tightening device. As a result, the metal band is sure to fit against the inside shape of the housing, even if this deviates somewhat from a true circular shape. Also, by means of the device according to the invention, the metal band can be pressed so tightly against the inner wall of the housing that even the pressure of a feeding trough bearing against the metal bank from the outside is not sufficient to force the metal band away from the inner wall of the housing.

The tightening device may vary in construction. Preferably the tightening device serves to secure the metal band at the same time. According to an advantageous embodiment the outside aperture of the housing widens out in the form of a wedge in the region of the inner wall of the housing and the tightening device comprises a tightening wedge which can be inserted between the two ends of the metal band from the inner wall of the housing and can be adjusted radially outwards from the outside of the housing. As a result of the radial adjustment, the tightening wedge is pulled even further into the aperture and parts the ends of the metal band so that the metal band bears tightly against the inner wall of the housing. According to a simple embodiment, which adapts itself particularly well to deviations in dimensions caused by the tolerances, the tightening device is constructed in the form of a screw device. In order to obtain a long length of screw without the risk of damaging the opening roller, the screw device may advantageously be formed by a threaded bolt connected to the tightening wedge and reaching through the outside aperture to the outside of the housing and a nut screwed onto its end. The ends of the metal band are preferably bent at an angle in the region of the tightening wedge to match its wedge shape. The ends of the metal band thus fit the wedge-shaped widening of the aperture in the inner wall of the housing. As a result, a precise fixing of the metal band in the peripheral direction of the housing is achieved. Furthermore, however, the parting and hence the tightening of the metal band in the housing is facilitated by the bent ends of the band. In order to secure the metal band in the axial direction in relation to the housing in a simple manner, according to the invention, the aperture and the tightening wedge only extend over a portion of the length of the joint, and the ends of the metal band engage round the tightening wedge at both longitudinal ends thereof.

According to another embodiment of the invention, the metal band comprises, at each of its ends, a hold-back portion or section which is bent at an angle and projects into the outside aperture, and the aperture is filled in with a filling composition which can be subsequently hardened and by which the metal band, tightened during the hardening time, is secured in the housing. The tightened metal band is held bearing against the inner wall of the housing until the filling composition has hardened, which then locates and secures the metal band in the tightened position in the housing by means of the filling composition and the hold-back sections projecting into the composition. In order to exchange the metal band, it is sufficient to knock the filling composition radially out of the aperture and replace it by fresh filling materials which can be done without any difficulty or additional tools anywhere and by anyone.

Apart from the angled hold-back sections, the metal band may advantageously have, in the region of the outside aperture, two sections extending transversely to the peripheral direction, between which a prestressing wedge is introduced to prestress and tighten the metal band during the hardening of the filling composition present between the angled hold-back sections. After the hardening of the filling composition, the prestressing wedge can be removed and the rest of the aperture filled in with the filling composition. By means of the filling composition, it is possible to achieve, in a simple manner, that the filling composition merges on the inner wall of the housing in a step-free manner.

Since the filling composition has to be inserted in two operational steps, the aperture filled in by the filling composition may appropriately be divided into two component apertures, one of which serves to receive the hold-back sections and the other of which serves to receive temporarily the prestressing wedge.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
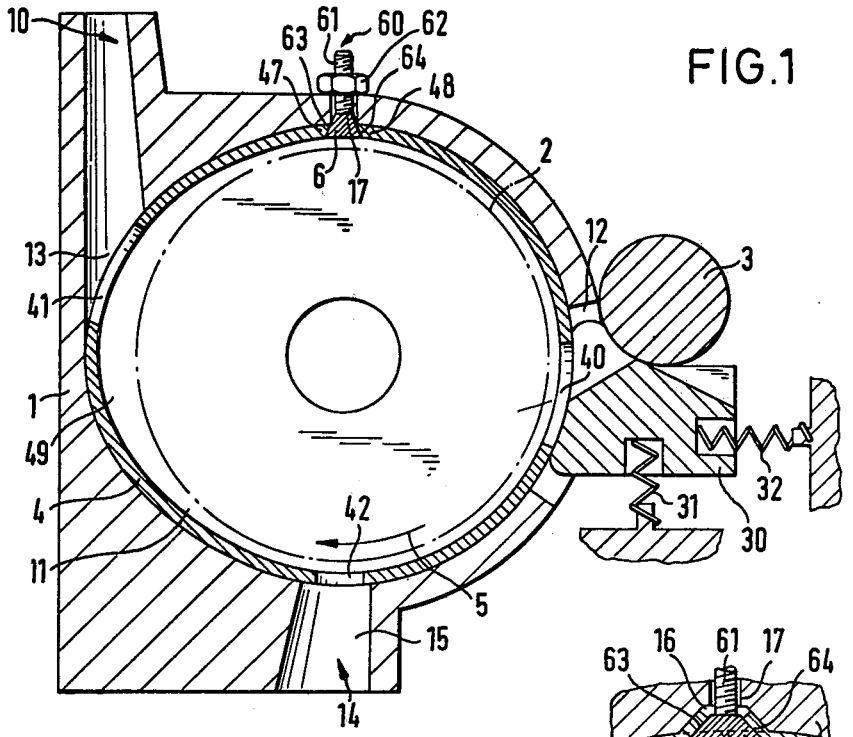
FIG. 1 shows a fiber opening device according to the invention in cross-section, wherein the tightening device serves to tighten and secure the insert at the same time.

Referring to the drawings, a fiber opening device is illustrated to which sliver to be spun is supplied in the usual manner to an opening roller 2 thereof which is accommodated in the interior 11 of a housing 1 and which opens out the sliver into individual fibers and conveys it in this form via a feed passage 10 to the open-end spinning apparatus (not shown).

The supply of the sliver is delivered by a device which comprises a delivery roller 3 and a loading member 30 which is pressed against the delivery roller 3 in the usual manner by a resilient element, for example, a compression spring 31.

The housing 1, which is made as a casting, comprises a plurality of housing apertures at the peripheral wall of its interior 11. One housing aperture 12 connects the delivery device 3, 30 to the interior 11. A housing aperture 13 connects the interior to the feed passage 10. If a dirt removal passage 14 is provided, then this is connected to the interior 11 through an additional housing aperture 15. The peripheral wall of the interior 11 includes a thin-walled and wear-resistant insert which is in the form of a finite metal band, preferably a spring steel band. This metal band 4 comprises an aperture 40, 41 and possibly 42 for each housing aperture 12, 13 and possibly 15. In order that a joint 46 (FIG. 2) between the two free ends 47 and 48 of the metal band 4 may not adversely affect the conveying of the fiber, this joint, as viewed in the direction of the conveyance of the fiber marked by the arrow 5, is disposed between the aperture 41 leading to the feed passage 10 and the aperture 40 leading to the delivery roller 3.

Figure 3:
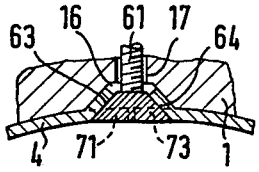
FIG. 3 shows a cross-section through a detail from FIG. 1.

As FIGS. 1 and 3 clearly show, in the region of the joint 46, a wedge-shaped recess 16 is provided in the housing, extending parallel to the axis of the opening roller 2 and the joint 46, and connected to the outside of the housing through an outside aperture 17 in the housing wall. Between the two ends 47 and 48 of the metal band 4 there is a tightening wedge 6, which is connected through the aperture 17 to a tightening device 60 at the outside of the housing. In the embodiment shown, which is particularly simple in construction, the tightening device 60 is constructed in the form of a screw device. Connected to the tightening wedge 6 is a threaded bolt 61 onto the end of which there is screwed a nut 62 outside the housing. By screwing the nut 62 onto the threaded bolt 61, the tightening wedge 6 is pulled into the wedge-shaped recess 16, its flanks 63 and 64 urging the ends 47 and 48 of the metal band 4 apart and so pressing it against the inner wall of the housing 1. As a result, over the whole periphery of the interior 11 of the housing, the metal band 4 bears against its peripheral wall. Even if a bulge 49 is provided in the housing 1 to aid in loosening the fiber from the opening roller 2 in the region of the aperture 41, the metal band 4 bears against the peripheral wall of the interior 11 of the housing differing from the circular shape. In the same way, the metal band 4 is held securely bearing against the peripheral wall of the interior 11 of the housing even if the loading member 30 is supported against the outside of the metal band under the action of a compression spring 32.

Naturally, the tightening device 60 may vary in construction. For example, the tightening wedge 6 may comprise an internal thread into which a screw reaching to the outside of the housing 1 may be screwed. Alternately, a pin or a plate with an undercut may be connected to the tightening wedge 6 and cooperate with a pivotable lever with an arm or a projection.

In order to reduce the friction between the ends 47 and 48 of the metal band 4 on the one hand and the tightening wedge 6 on the other hand, during the tightening operation, the ends 47 and 48 of the metal band may advantageously be bent at an angle in accordance with the wedge shape in the region of the tightening wedge 6 (FIG. 3).

As can be seen from the drawings, the tightening wedge 6 does not necessarily have to have a sharp wedge edge. This may be rounded or cut off so that the tightening wedge 6 can even have a trapezoidal shape. What is important for the present invention is that the tightening wedge 6 has flanks 63 and 64 which approach one another, so that the wedge action is achieved with respect to the metal band 4. In a similar manner, the wedge-shaped recess 16 may have a rounded or flattened bottom.

Figure 2:
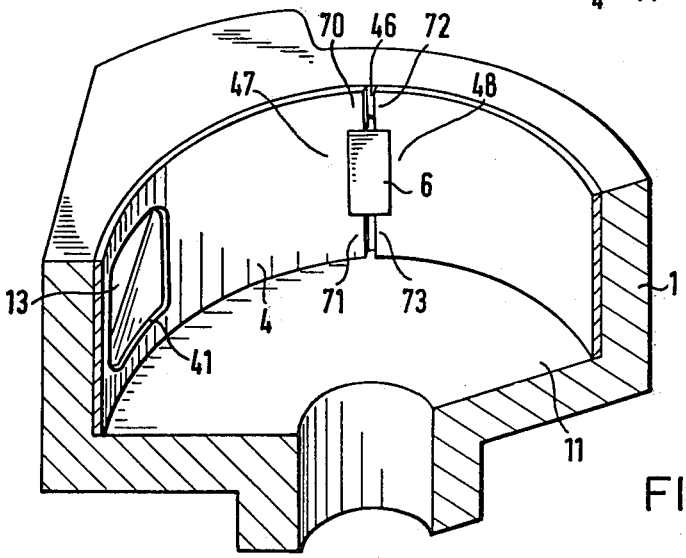
FIG. 2 shows the opening roller housing constructed according to FIG. 1 in perspective, in section.

In order to secure the metal band 4, which is secured by the wedge-shaped recess 16 in the peripheral direction, that is with respect to the interior 11 of the housing 1, and in the axial direction also, according to another development of the subject of the invention, the recess 16 and the tightening wedge 6, which is adapted in its length to the recess 16, extend only over a portion of the joint 46 (FIG. 2). In this case, the ends 47 and 48 of the metal band 4 are forked and engage with their arms 70 and 71 and 72 and 73 around the tightening wedge 6 at the longitudinal ends thereof.

As the above description shows, the method on which the invention is based consists in that first the metal band 4 is inserted in the housing 1 so that the joint 46, seen in the direction of conveying of the fiber, in clockwise direction in FIG. 1, is between the housing aperture 13 leading to a feed passage 10 and the housing aperture 12 leading to a delivery device 3, 30. This may be done without the metal band 4 having been previously coated with adhesive, as is the case in the methods previously known. Then the metal band is brought to bear against the inner wall of the housing by tightening and is held there until the metal band thus tightened in the region of the joint 46 is secured in the housing by a quick release connection. Then the tightening device can be removed or can also remain on the housing 1, according to its construction.

In order to carry out this method there are many possible constructions of the fiber opening device.

Figure 4:
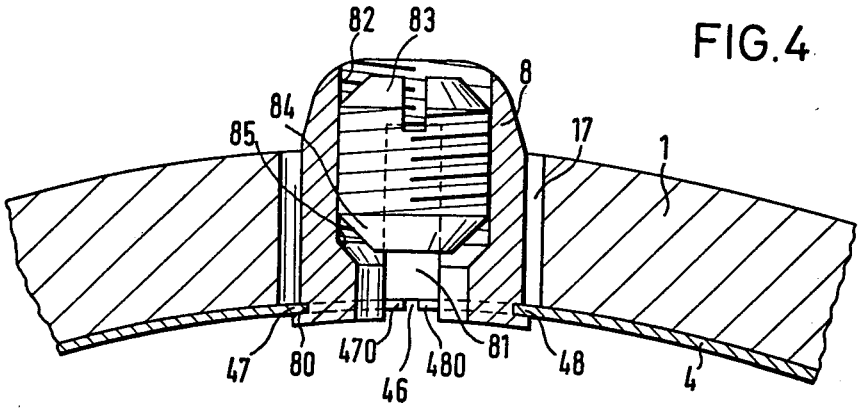
FIG. 4 shows a modification of the construction of the subject of the invention shown in FIG. 1, in cross-section.

FIG. 4 shows a further construction of the subject of the invention wherein, as in the embodiment shown in FIGS. 1 to 3, the tightening device serves to secure the metal band 4 at the same time. In this case too, a tightening device is introduced into the outside housing aperture 17, which is round in this case. The tightening device consists of a bushing 8 which extends from the inside of the housing 1 to its outside. In the immediate vicinity of its end adjacent to the interior 11 of the housing 1, the bushing 8 comprises an annular groove 80 at its exterior in which the two ends 47 and 48 of the metal band 4 engage. Naturally, the metal band 4 comprises corresponding semicircular recesses 470 and 480 at its two ends 47 and 48. In the region of the joint 46, the bushing 8 has a slit 81 parallel to this. In addition, at the end remote from the interior 11 of the housing 1, the bushing 8 has an internal thread 82 which reaches close to the metal band 4. Screwed into this internal thread 82 is a threaded pin 83 which is made frusto-conical at its end 84 adjacent to the interior 11 of the housing 1. When the threaded pin 83 is screwed in, its frusto-conical end 84 ultimately reaches the outlet 85 of the thread and so expands the bushing 8. As a result, the ends 47 and 48 are wedged apart and the metal band 4 is tightened and securely held in the annular groove 80.

In order to replace the metal band 4, it is sufficient to unscrew the threaded pin 83 somewhat in the bushing 8 so that the bushing 8 can relax and release the ends 47 and 48 of the metal band 4.

Figure 5:
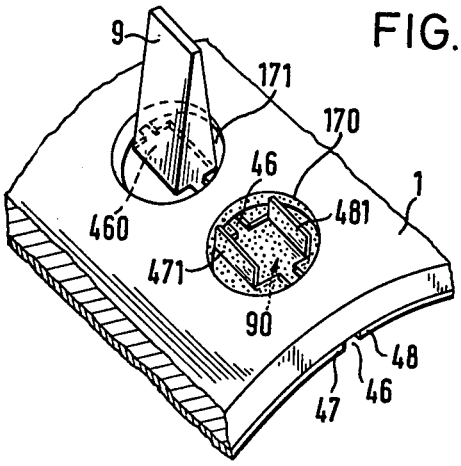
FIG. 5 shows a further embodiment of the device according to the invention in perspective, wherein the tightening and securing of the insert are effected by separate means.

FIG. 5 shows another embodiment of the subject of the invention wherein the securing element does not form the tightening device at the same time. The metal band comprises, in the region of a first aperture 170 in the housing 1, at each end 47 and 48, a hold-back portion or section 471 and 481 which is bent at an angle and which projects into the outside housing aperture 170.

Apart from the aperture 170, the housing 1 comprises, in the region of the joint 46, a further outside aperture 171 in the region of which the joint 46 has a rectangular widened portion 460 to receive temporarily a prestressing wedge 9. This prestressing wedge 9 remains in the widened portion 460 between the ends 47 and 48 of the metal band until the aperture 170 has been filled with a filling composition 90 which hardens subsequently. For example a non-shrinking casting resin may be utilized. After the prestressing wedge 9 has been removed, after this filling composition 90 has hardened, the aperture 171 is also filled in with the filling composition 90. Preferably a filling composition 90 is used which is introduced into the apertures 170 and 171 in the cold state. Then it is sufficient to cover the joint 46 with an adhesive tape. In this manner, the filling composition 90 forms a gradual continuation of the face of the metal band 4 adjacent to the interior 11 of the housing after hardening. This is a particular advantage in preventing individual fibers which have not separated from the opening roller 2 at the housing aperture 13 (FIG. 1) and which continue to rotate with the opening roller 2 from remaining caught up at the joint. Because of the gradual filling in of the metal band 4 and joint thereof by the filling composition 90 these individual fibers are prevented from remaining caught up.

The securing of the metal band 4 in the housing 1 is effected as follows. After the metal band 4 has been introduced into the housing 1 and brought into the correct position so that the apertures 40, 41 and possibly 42 are precisely over the housing apertures 12, 13 and possibly 14 FIG. 1) and the hold-back sections 471 and 481 project into the aperture 170 and the widened portion 460 is disposed in the region of the aperture 171, the prestressing wedge 9 is introduced from the interior 11 of the housing 1 into the region of the widened portion 460 between the ends 47 and 48 of the metal band 4 to such an extent that the metal band 4 bears firmly and completely against the inner wall of the housing 1. The prestressing wedge 9 is now left in this position and the joint 46 in the region of the hold-back sections 471 and 481 is covered with an adhesive tape or the like from the inside of the housing. Now the filling composition 90 is introduced into the aperture 170 from the outside of the housing and the hardening of the filling composition 90 is awaited. When this has happened, the prestressing wedge 9 can be knocked out of the widened portion 460 in the direction of the interior 11 of the housing 1, from the outside.

Since the hold-back sections 471 and 481 are firmly anchored in the filling composition, the filling composition 90 and the hold-back sections 471 and 481 ensure the precise position of the metal band 4 in the housing 1. After removal of the prestressing wedge 9, the joint 46 is also covered with an adhesive tape or the like in the region of the widened portion 460 and the aperture 171 is filled with filling composition 90 which subsequently hardens. After hardening of the filling composition 90, the adhesive tape can be removed again from both apertures 170 and 171, at the inside of the housing, and the fiber opening roller housing is ready for use.

Modification may also be made to the construction of the subject of the invention shown in FIG. 5. Thus the apertures 170 and 171 may be combined to form a single aperture. Care must merely be taken, when filling in the aperture in the region of the hold-back sections 471 and 481 that the aperture in the region of the widened portion 460 is not filled in with filling composition 90, which can be effected by masking by means of an adhesive tape or by plugging.

The tightening of the metal band 4 during the insertion and hardening of the filling composition 90 may be done by any tightening device action radially towards the outside, which acts on the metal band from the interior 11 of the housing 1 instead of by means of a prestressing wedge 9. In such case, the widened portion 460 and the enlargement of the aperture for the hold-back sections 471 and 481 to receive the prestressing wedge 9 or the widened portion 460 and the aperture 171 can be dispensed with.

With the construction of the subject of the invention explained with reference to FIG. 5, in order to replace the metal band, it is sufficient to knock out the hardened filling composition 90 in the aperture or in the apertures 170 and 171 in the direction of the interior 11 of the housing 1. The loosening of the filling composition is very simple despite a satisfactory securing of the metal band 4 in normal operation of the fiber opening device. The insertion and securing of the new metal band 4 is then again effected in the manner already described.

The embodiment of the subject of the invention described with reference to FIG. 5, wherein the tightening device and securing element for the metal band 4 are separate devices, has the advantage that each of these two devices can be specially adapted to this purpose. In this manner, the metal band 4 can be better tightened than by means of an apparatus comprising both devices and tolerances are better compensated for.

Figure 6:
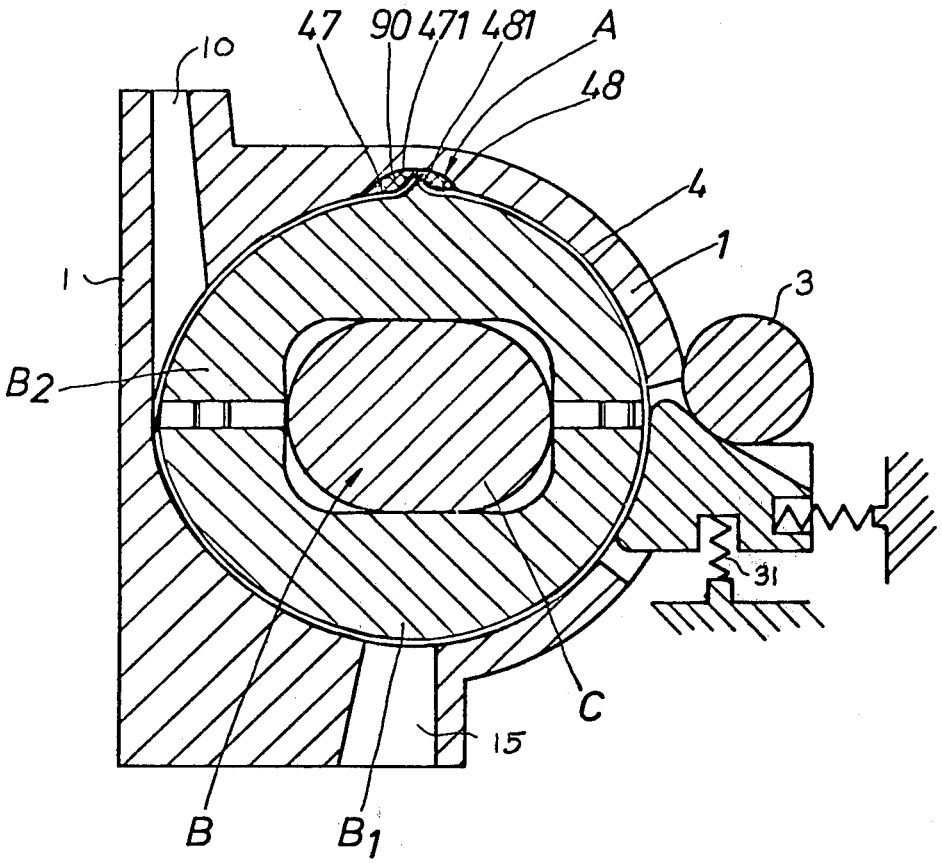
FIG. 6 shows a cross-section a modified form of the invention.

FIG. 6 illustrates a modified form of the invention wherein the ends of a metal band are secured in a recess A by means of resin. The metal band 4 in this case exhibits ends 47 and 48 having retainer sections 471 and 481 which project into a recess A in the inner wall of the housing 1. The metal band is stretched by a clamping device B which is accommodated in the interior of the housing 1, in which, for example, two segments B1 and B2 get pressed outwards against the inner wall of the housing 1 by a twistable cam C. Now the recess A is plugged with a resin 90 or the like, where it sets and secures the retainer sections 471 and 481 in the recess. The pouring in is effected in this case from the side of the housing 1, exposed by a side cover (not shown). By turning the cam C the clamping device B may be loosened and then taken out of the housing 1.

If the metal band 4 has to be exchanged, a sharp object may be hammered into the resin so that it bursts and releases the retainer sections 471 and 481, whereupon the metal band may be taken out of the housing 1.

While a preferred embodiment of the invention has been described using specific terms, such description is for illustrative purposes only, and it is to be understood that changes and variations may be made without departing from the spirit or scope of the following claims.

What is claimed is:

1. A method of lining a housing which receives an opening roller of a fiber opening device associated with an open-end spinning apparatus by means of a metal band, wherein the housing comprises apertures surface which connect the interior of the housing to other parts of the spinning apparatus and to which apertures in the metal band correspond, said method comprising:

providing a metal band having free ends defining a joint therebetween;

inserting said metal band in the housing so that said joint as viewed in the direction of conveying of the fiber is between an aperture in the housing leading to a feed passage and an aperture in the housing leading to a delivery device;

tightening the metal band to bear against the inner wall of the housing; and securing the tightened metal band in the region of the joint in the housing by means of a fixed connection.

2. The method as set forth in claim 1 further comprising:

inserting an expandable member within said metal band for tightening said metal band to bear against the inner wall of said housing.

* * * * *